US005265783A

United States Patent [19]

Iqbal

[11] Patent Number: 5,265,783

[45] Date of Patent: Nov. 30, 1993

[54] BAG

[76] Inventor: Mohammed M. Iqbal, 4F, 14-1, Nazimabad, Karachi, Pakistan, 74600

[21] Appl. No.: 928,702

[22] Filed: Aug. 13, 1992

[30] Foreign Application Priority Data

Sep. 30, 1991 [GB] United Kingdom ..... 9120760

[51] Int. Cl.[5] ..... B65D 33/14

[52] U.S. Cl. ..... 224/205; 383/7

[58] Field of Search ..... 224/205, 202, 254, 257, 224/906; 206/438; 383/7, 902

[56] References Cited

U.S. PATENT DOCUMENTS

| | | | |
|---|---|---|---|
| 3,873,735 | 3/1975 | Chalin et al. | 383/7 |
| 4,754,903 | 7/1988 | Dennis | 224/205 |
| 4,793,486 | 12/1988 | Konopka et al. | 224/205 |
| 4,946,094 | 8/1990 | Stang | 224/202 |
| 4,985,932 | 1/1991 | Bezdek | 224/202 |

FOREIGN PATENT DOCUMENTS

| | | | |
|---|---|---|---|
| 263621 | 7/1968 | Austria | 383/7 |
| 3539203 | 5/1987 | Fed. Rep. of Germany | 383/7 |

*Primary Examiner*—Renee S. Luebke
*Attorney, Agent, or Firm*—Young & Thompson

[57] ABSTRACT

A snack food or confectionery bag gives the consumer both hands free by providing a built in loop or strap to be placed around the neck or over the shoulder and enables the consumer to eat the contents at will. The novel bag also has a built-in easy bag opening facility by providing two lips at the top of the content area, not sealed with each other to be held between index finger and thumb of each hand and pulled apart. The loop or strap is so designed that it will not tangle with each other during packing process while manufacturing.

9 Claims, 4 Drawing Sheets

BAG

FIELD OF THE INVENTION

This invention relates to a bag to be used for packing snack foods and confectionery products and to a method of manufacturing such a bag.

BACKGROUND OF THE INVENTION

The normal bag used for packing foods and confectionery products needs to be held in one hand while the contents are consumed by the other hand.

This restriction of one hand "occupied" makes the user uncomfortable specially when during this time one has to:

a) take a drink;

b) hold a railing, or balustrade when using an escalator or stairs or boarding a train or a bus;

c) hold a companion's hand while walking in a busy place;

d) hold a book or a balloon or anything else to play with or do something with both hands.

Before doing any of the above, either the action of eating has to be halted or one has to wait till the contents are finished and the bag properly disposed of. Hence the consumer does not enjoy the contents as much as he might, and is often forced to eat more quickly than he would like.

SUMMARY OF THE INVENTION

In accordance with this invention, a bag is provided for snack goods and/or confectionery products formed by a process which fills and seals the bag, wherein a portion of the bag has a pattern of perforations or cuts such that the portion can be extended to form a loop for hanging the bag.

The loop is preferably suitable for hanging the bag from the neck of a user.

The pattern of perforations may include punched holes and may include at least one horizontally extending line which does not cut the sides of the bag, and at least one horizontally extending line which does cut one side of the bag.

In one embodiment, these horizontally extending lines terminate in punched holes and the pattern of perforations or cuts is such as to provide, when the perforated portion is extended, two lips which can be gripped for opening the bag. This provides an easy peal open seal.

The bag may be made from one or two rolls of plastics film material.

Also in accordance with the invention, a method is provided of making a bag for snack foods and/or confectionery products from one or two rolls of plastics film material using a vertical or horizontal form fill seal and cut machine by first forming a tube then forming a narrow seal at the bottom of the bag, filling the bag with confectionery or snack goods product, forming a wide seal at the top of the bag, perforating or cutting a pattern in the wide seal such that the material of the wide seal can be extended by pulling to form a loop for hanging the bag.

The new invention gives the user "a free hand" to carry out any of the above activities while the "eating" is still going on, thus the user feels comfortable and safe and has more time to enjoy eating with both hands free.

DETAILED DESCRIPTION

The following description is meant to be illustrative only and not limiting. Other embodiments of this invention will be obvious to those skilled in the art in view of this description.

Figure 1:
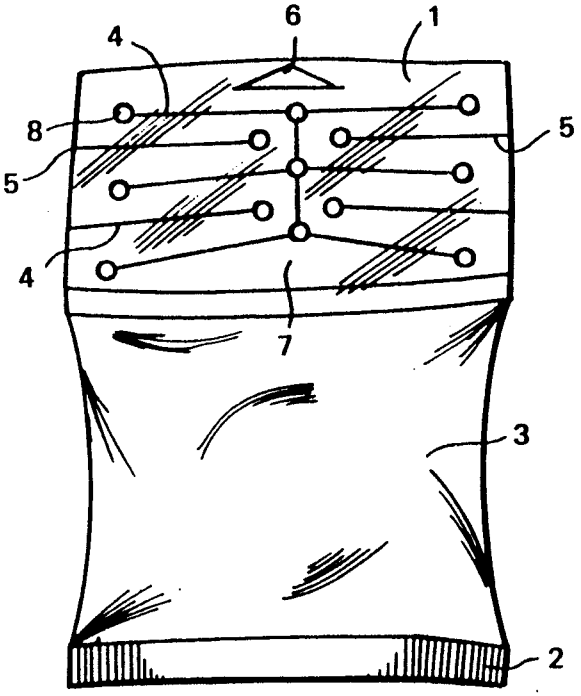
FIG. 1 shows a perspective view of a bag according to the invention.

FIG. 1 shows a bag according to this invention which has an extended seal area 1 on top and a normal seal area 2 at the bottom and contents area 3. A specially designed profile 4 will be cut in area 1 with some points of weakening 5 on left and right hand sides of area 1.

When the top edge 6 is pulled in the indicated direction, the pre-cut profile will transform into a frill like loop or strap. This loop or strap could be placed around the neck or over the shoulder when required.

After the loop or strap is pulled, a triangular portion 7 will be accessible. The film in this part of the area 2 is not sealed together and can be pulled apart by holding the lips between index fingers and thumbs of each hand. Thus making an opening to the content area 3.

Plastics films tend to tear at sharp corners, this problem is eliminated by punching a hole 8 at the end of every cut, so as to distribute the stress over the punched area instead of at one specific point and stop the film from tearing beyond the intended perforation line.

The bag would be purchased in the form indicated in the perspective view of FIG. 1.

Figure 2:
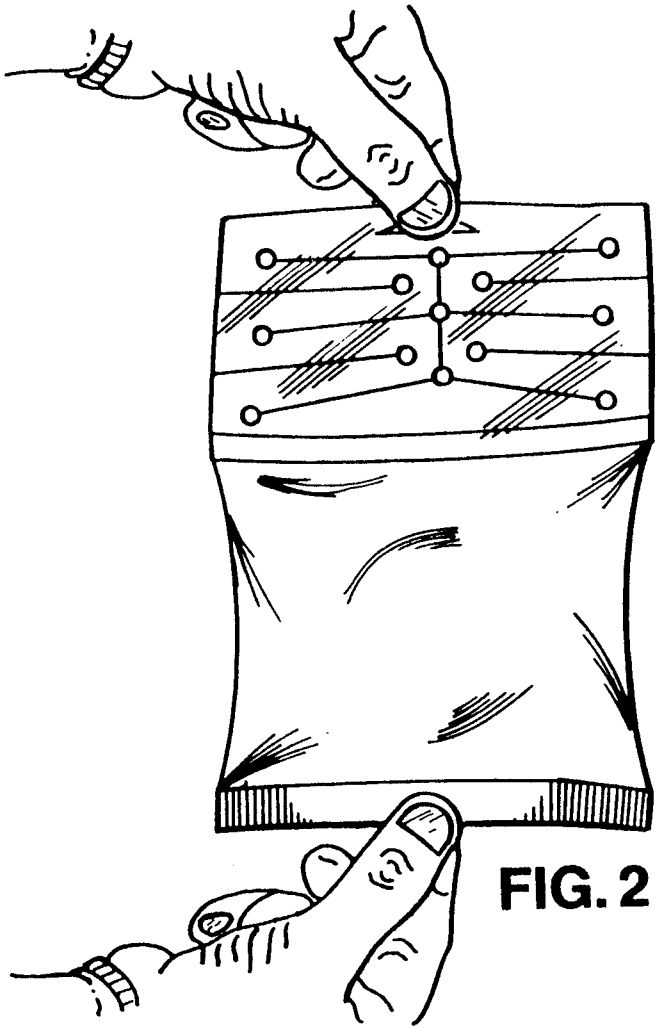
FIG. 2 shows the bag of FIG. 1 being held prior to pulling out the loop.

A purchaser would hold the bag as indicated in FIG. 2 before pulling out the loop/strap.

Figure 3:
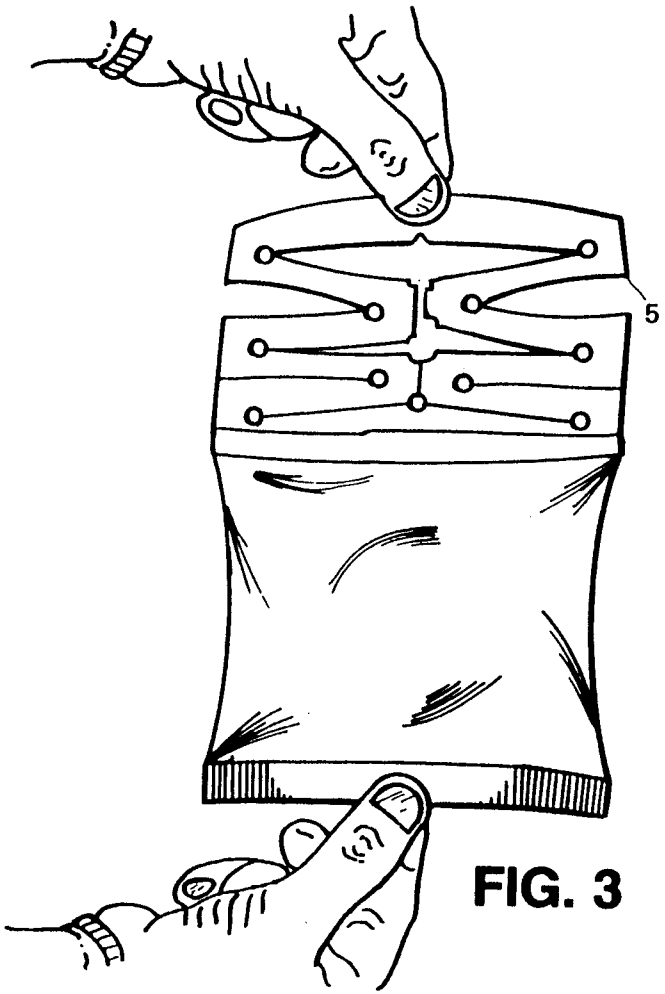
FIG. 3–6 shows the bag of FIG. 1 with the loop or handle in successive stages of extension.

FIG. 3 shows the marked portion 5 being pulled.

Figure 4:
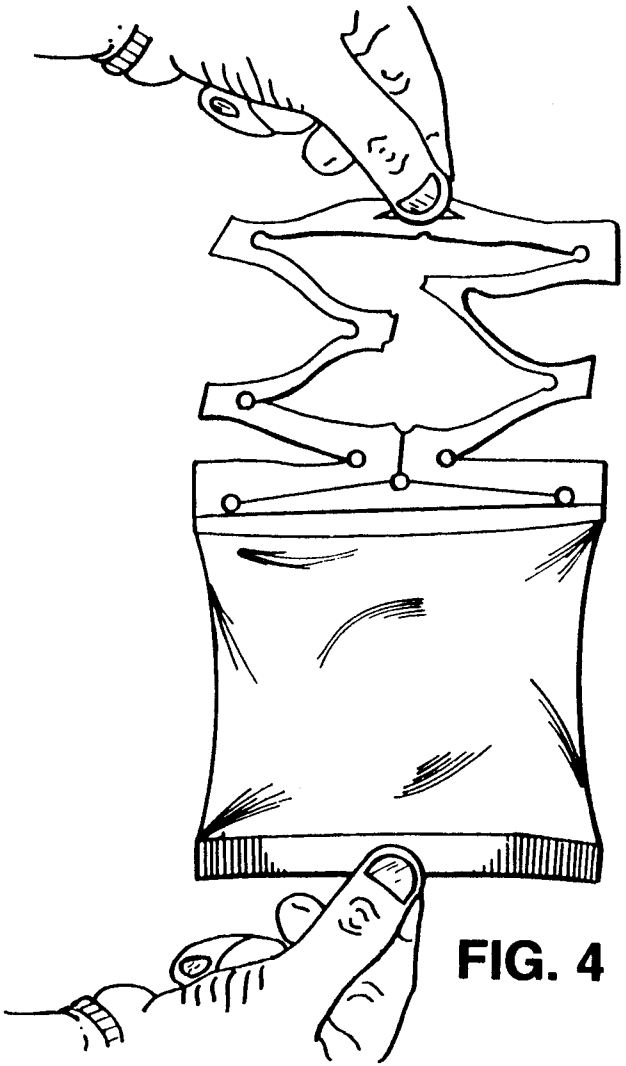
Figure 5:
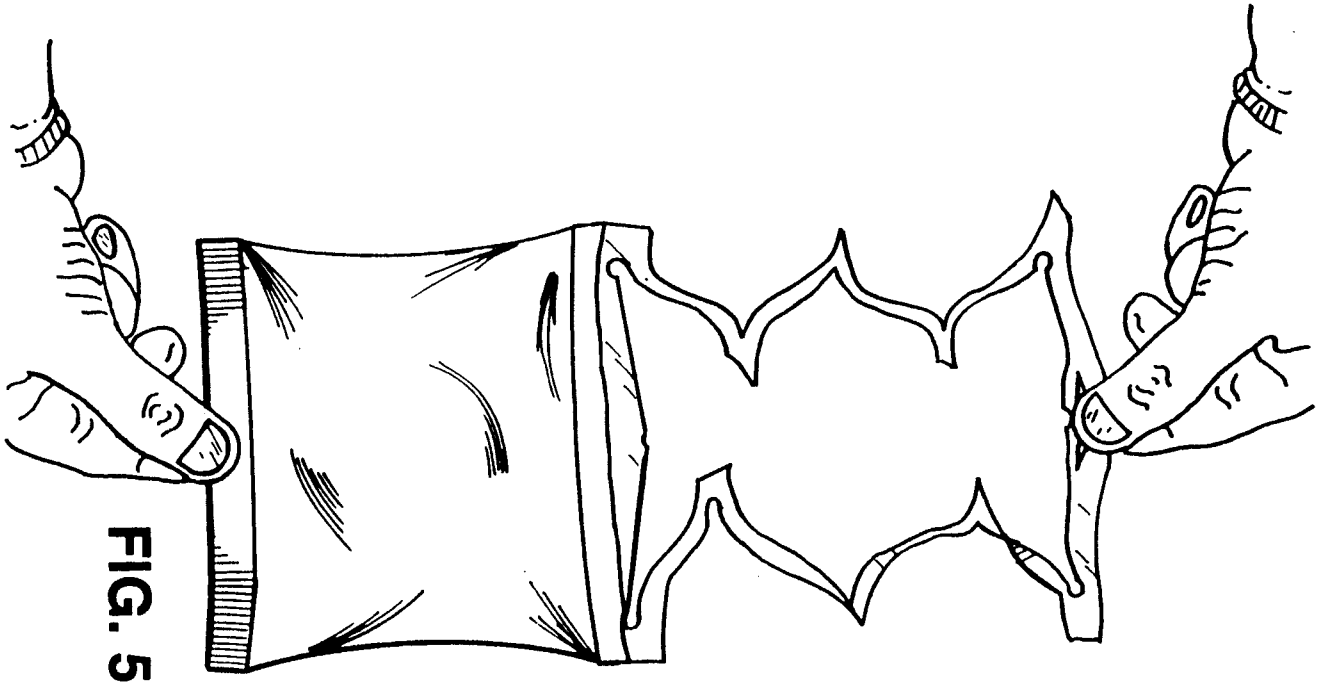
Figure 6:
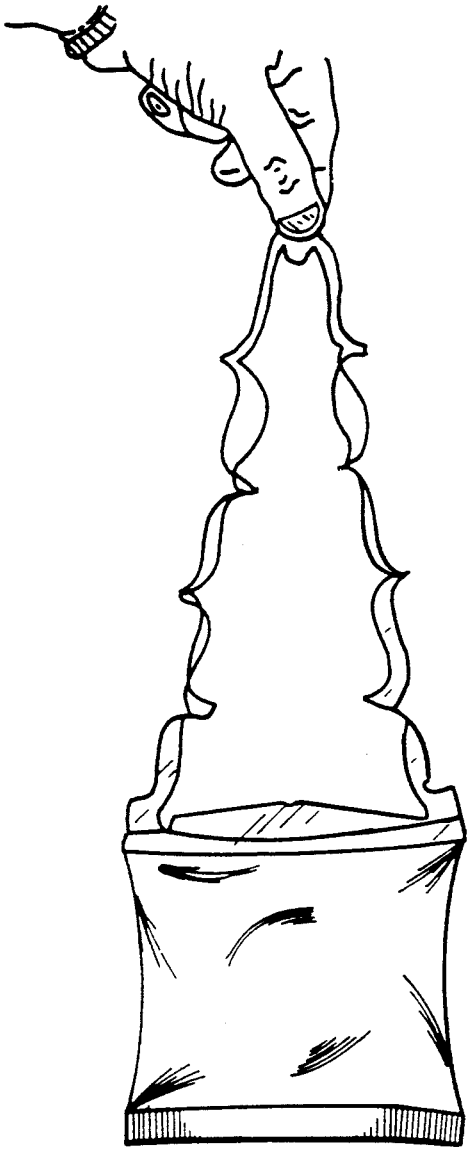

FIG. 4, 5 and 6 shows the process of transformation of a bag into a loop/strap bag in different stages.

Figure 7:
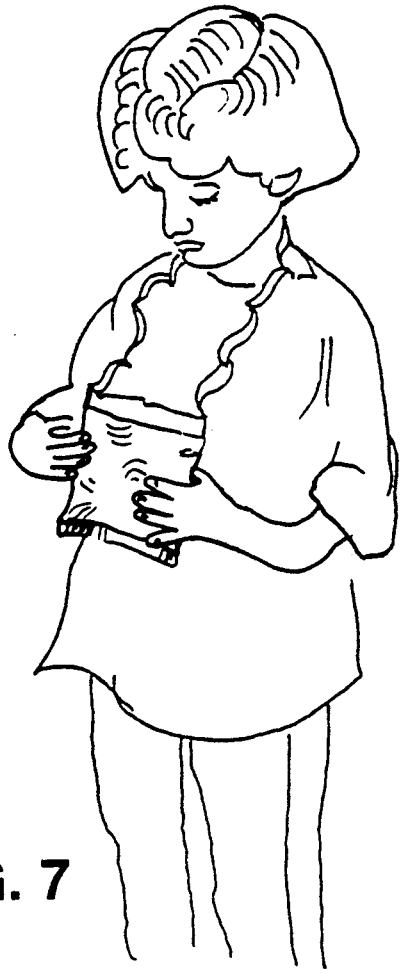
FIG. 7 shows the bag of FIG. 1 in use.

Finally the bag is placed around the neck of a child as shown in FIG. 7 and opened by pulling on lip 7, as explained above.

What we claim is:

1. A disposable bag made by a fill and seal process, said bag having a top and bottom, and comprising:

a narrow seal portion at the bottom of the bag;

a wide seal portion at the top of the bag; and a quantity of snack food sealed into the bag between said narrow seal portion and said wide seal portion;

a pattern of perforations formed in said wide seal portion, wherein said pattern of perforations includes at least one perforated line, which does not cut a side of the bag, said line terminating at its two ends in punched holes, and at least one perforated line which does cut a side of said bag, and wherein due to said pattern of perforations, said wide seal portion can be extended to form a loop for hanging said bag from a neck of a user.

2. A bag according to claim 1, wherein at least one of said perforated lines extends generally parallel to the top of the bag.

3. A bag according to claim 1, wherein the wide seal portion includes an unsealed area and said pattern of perforations is formed so as to provide, when the wide seal portion is extended, two lips which can be gripped for opening the bag.

4. A bag according to claim 1, wherein said bag is made from plastics film material.

5. A bag according to claim 4, wherein the bag is made using one roll of film material formed into a tube which is then sealed transversely to form said narrow seal portion below a hollow portion into which is then inserted a snack food product and said tube is then sealed transversely again at a spaced location from the first transverse seal to form said wide seal portion.

6. A bag according to claim 4, wherein the bag is made using two rolls of plastics film material, said film on said rolls is unwound from said rolls and sealed together at their long edges to form a tube and said tube then is sealed transversely at spaced intervals in alternation with the introduction of a snack food product into said tube.

7. A method of making a bag for snack foods or confectionery products from one or two rolls of plastics film material using a vertical or horizontal form fill seal and cut machine, said method comprising the steps of:

a) forming a tube by sealing said one or two rolls at long edges to form said tube;

b) forming a narrow seal transversely of said tube to form a bottom of said bag;

c) inserting confectionery or snack goods product into said tube;

d) forming a wide seal transversely of said tube, above said product to form the top of said bag;

e) perforating or cutting a pattern in said wide seal such that said wide seal can be extended by pulling to form a loop for hanging the bag round a neck of a consumer.

8. The method of making a bag according to claim 7, wherein steps d) and e) are performed simultaneously.

9. A bag for snack goods or confectionery product made by the method of claim 7.

* * * * *